US010883152B2

(12) United States Patent
Chen et al.

(10) Patent No.: US 10,883,152 B2
(45) Date of Patent: Jan. 5, 2021

(54) DYNAMICALLY IMPACTING METHOD FOR SIMULTANEOUSLY PEENING AND FILM-FORMING ON SUBSTRATE AS BOMBARDED BY METALLIC GLASS PARTICLES

(71) Applicants: Kuan-Wei Chen, Tainan (TW); Jason Shian-Ching Jang, Tainan (TW); Po-Jen Wei, Tainan (TW)

(72) Inventors: Kuan-Wei Chen, Tainan (TW); Jason Shian-Ching Jang, Tainan (TW); Po-Jen Wei, Tainan (TW)

(73) Assignee: Taichi Metal Material Technology Co., Ltd., Tainan (TW)

( * ) Notice: Subject to any disclaimer, the term of this patent is extended or adjusted under 35 U.S.C. 154(b) by 218 days.

(21) Appl. No.: 16/111,176

(22) Filed: Aug. 23, 2018

(65) Prior Publication Data

US 2020/0063226 A1 Feb. 27, 2020

(51) Int. Cl.

| | |
|---|---|
| ***C21D 7/06*** | (2006.01) |
| ***B22F 9/00*** | (2006.01) |
| ***B22F 9/08*** | (2006.01) |
| ***B24C 1/10*** | (2006.01) |

(52) U.S. Cl.

CPC ..... *C21D 7/06* (2013.01); *B22F 9/002* (2013.01); *B22F 9/082* (2013.01); *B24C 1/10* (2013.01); *B22F 2009/0848* (2013.01); *B22F 2201/20* (2013.01)

(58) Field of Classification Search

CPC .. B21D 31/06; C21D 7/06; B24C 1/10; B24B 39/006; B23P 9/04; B22F 200/0848

See application file for complete search history.

(56) References Cited

U.S. PATENT DOCUMENTS 4,228,670 A * 10/1980 Corti ..... C10M 103/06 72/42

* cited by examiner

*Primary Examiner* — Debra M Sullivan

(57) ABSTRACT

A dynamically impacting method comprising simultaneously peening a substrate surface and forming a thin film of metallic glass on the substrate surface for increasing the surface hardness, fatigue resistance, anti-fracture toughness and corrosion resistance of the substrate simultaneously.

1 Claim, 1 Drawing Sheet

DYNAMICALLY IMPACTING METHOD FOR SIMULTANEOUSLY PEENING AND FILM-FORMING ON SUBSTRATE AS BOMBARDED BY METALLIC GLASS PARTICLES

BACKGROUND OF THE INVENTION

U.S. Pat. No. 8,323,729 to Inoue et al. disclosed a process for producing a metal member comprising: a shot peening treatment including projecting particles onto a surface of a metal material comprising an aluminum alloy using a compressed gas for enabling fatigue properties of the metal member; and a chemical conversion treatment including forming a film on the surface of the metal material by performing a chemical conversion treatment following the shot peening treatment to enable the corrosion resistance of the metal member.

In order to enable both fatigue properties and corrosion resistance of the metal member, it requires two steps, namely, a first shot peening on the metal surface and then a further chemical conversion treatment for forming a protective film on the shot-peened surface.

So, it is complex for the surface treatments, thereby increasing the production cost of the metal member.

The present inventor has found the drawbacks of the conventional method, and invented the dynamically impacting method for simultaneously peening and film-forming on a substrate of a work piece or structural object.

SUMMARY OF THE INVENTION

The object of the present invention is to provide a dynamically impacting method for simultaneously peening a substrate surface and forming a thin film of metallic glass on the substrate surface for increasing the surface hardness, fatigue resistance, fracture toughness and corrosion resistance of the substrate simultaneously.

DETAILED DESCRIPTION

In accordance with the present invention, particles of metallic glass or liquid metal alloy are provided for shot peening and film-forming on a substrate, preferably a metal substrate or an alloy substrate of a work piece or an engineering, structural object not limited in the present invention.

The process steps of the present invention comprises:

1. Preparation of Metallic Glass particles:
   - A raw material of metallic glass or liquid metal alloy is prepared by adjusting a proper atomic percentage of the elements forming the metallic glass.
   - The raw material of metallic glass is then put into a vacuum furnace for melting the metallic glass and then quickly cooled and atomized by an ultrasonic argon gas to produce metallic glass particles.
   - The metallic glass particles are then collected and classified into several grades, for instance, a particle size of 5~10 microns, 10~20 microns, 20~50 microns, 50~100 microns, and 100~300 microns. The smaller the particle size is, the finer and denser the peened surface on the substrate will be.

Figure 1:
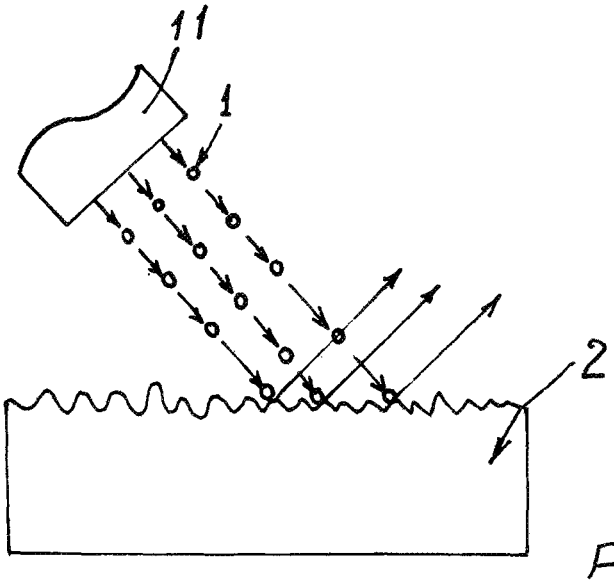
FIG. 1 is an illustration showing the dynamically impacting method as performed in the present invention.
Figure 2:
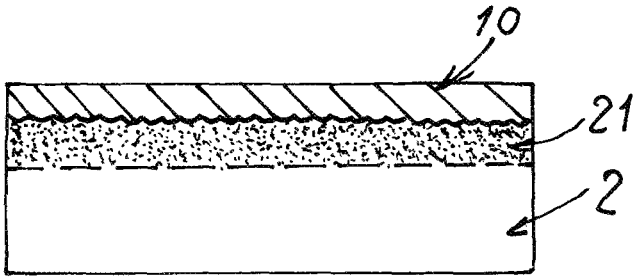
FIG. 2 is a sectional illustration showing the surface treatment of a substrate in accordance pith the present invention.

2. Bombardment of the Metallic Glass particles on the substrate:
   - The metallic glass particles 1 are bombarded against a surface of the substrate 2 as shown in FIG. 1. The metallic glass particles are ejected through a nozzle or gun 11 as driven by compressed inert gas including argon to dynamically bombard the substrate surface to harden and smoothen the corrugated or rough substrate surface.
   - Substantially, the substrate 2 has its upper surface portion hardened to be a hardening zone 21 as shown in FIG. 2. Since the metallic glass particles 1 are continuously bombarded on the substrate surface, the above-mentioned corrugated or rough surface will then be smoothened by the further bombardment of metallic glass particles, thereby forming a metallic glass thin film 10 over the hardening zone 21
   - By so doing, the hardening zone 21 may increase the hardness, fatigue resistance and fracture toughness of the substrate, and the metallic glass thin film 10 may further increase the corrosion resistance of the substrate. Comparatively, this invention may increase the hardness and the corrosion resistance simultaneously, rather then the two-steps as disclosed in the prior art of U.S. Pat. No. 8,323,729 as early depicted in the "Background of the Invention" of the Specification.
   - Critically, the bombardment of the metallic glass particles on the substrate may be further divided into two sub-steps, namely:
   - A. High-Pressure Bombardment:
     - The metallic glass particles are bombarded against the substrate surface at a speed of at least 10 meters/second as driven by compressed argon gas under a high pressure of 5~15 bars to harden and smoothen the substrate surface.
   - B. Low-Pressure Bombardment:
     - The metallic glass particles are further bombarded against the substrate surface under a low pressure of 0.1~5 bars to rapidly superimposedly form thin films of metallic glass on the substrate surface, thereby forming a corrosion resistant surface with polishing (smooth and shiny) appearance.
     - Therefore, the finished surface of the substrate may have hardened zone 21 and metallic glass thin-film layer 10 for enhancing both hardness and corrosion resistances to be superior to the prior art.
     - By bombarding metallic glass particles on a 6061 aluminum substrate, the surface hardness is 23.41 GPa (2212 Hv), which has been greatly increased in comparison with that untreated with metallic glass bombardment (only 1.13 GPa, 107 Hv).
     - Meanwhile, after bombardment of the metallic glass particles on the high speed steel pitch mold surface, the hardness has been increased from 7.06 GPa (667 Hv) to 22.03 GPa (2082 Hv). Furthermore, it is not corroded (without forming oxide layer) after exposure to the air for 3 weeks.

The present invention has the following advantages superior to the prior art and the conventional shot peening:

1. The metallic glass particles may be formed as a true spherical shape to form a smooth polishing surface after bombardment.

2. The metallic glass particles have high anti-fracture strength, not easily broken to injure the processing surface and the particles may also be recycled for re-use.
3. The metallic glass has high hardness and density to thereby increase its dynamic energy when bombardment against the substrate to form a bombarded surface with increased hardness.
4. The metallic glass particles when impacted on the substrate will be partially melted due to frictional heat when impacting the substrate surface at high speed (such as 10 meters/second or even higher) to a temperature higher than its glass transition temperature (Tg) so as to form a thin film of metallic glass to be adhered on the substrate surface, which will be quickly cooled to a room temperature to still keep its amorphous property. It is very important since such a metallic glass thin film as formed on the substrate surface will render a better corrosion resistance of the substrate of the work piece or structural object. A production cost may then be greatly reduced.

Conclusively, without further treatment for corrosion resistance, the bombardment of the metallic glass particles on the substrate surface, it may render the substrate surface to be corrosion resistant in addition to the increasing of hardness, the fatigue resistance and the anti-fracture toughness.

The present invention may be further modified without departing from the spirit and scope of the present invention.

We claim:

1. A dynamically impacting method comprising:

A. preparing metallic glass particles by melting a metallic glass raw material in a vacuum furnace and then quickly cooling and atomizing the raw material to form metallic glass particles; and B. bombarding the metallic glass particles against a substrate comprising:

a first bombarding step of high-pressure bombardment by bombarding metallic glass particles at a speed of at least 10 meters/second as driven by a compressed inert gas under a high pressure ranging from 5 bars through 15 bars to harden and smoothen a surface of said substrate; and a second bombarding step of low-pressure bombardment by further bombarding the metallic glass particles under a low pressure ranging from 0.1 bars through 5 bars to rapidly superimpose a thin film of metallic glass on said surface of said substrate to form a corrosion resistant surface with polishing appearance.

* * * * *